US011812913B2

(12) United States Patent
Cabrera

(10) Patent No.: US 11,812,913 B2
(45) Date of Patent: Nov. 14, 2023

(54) COMPACT DISHWASHER FOR CLEANING A FEW EATING UTENSILS

(71) Applicant: Marcus Cabrera, Chandler, AZ (US)

(72) Inventor: Marcus Cabrera, Chandler, AZ (US)

( * ) Notice: Subject to any disclaimer, the term of this patent is extended or adjusted under 35 U.S.C. 154(b) by 28 days.

(21) Appl. No.: 17/591,828

(22) Filed: Feb. 3, 2022

(65) Prior Publication Data

US 2023/0240503 A1 Aug. 3, 2023

(51) Int. Cl.
*A47L 15/00* (2006.01)
*A47L 15/42* (2006.01)
*A47L 15/16* (2006.01)

(52) U.S. Cl.
CPC ..... *A47L 15/0089* (2013.01); *A47L 15/16* (2013.01); *A47L 15/4225* (2013.01); *A47L 15/4285* (2013.01)

(58) Field of Classification Search
CPC .. A47L 15/0089; A47L 15/16; A47L 15/4225; A47L 15/4285
USPC ..... 134/200
See application file for complete search history.

(56) References Cited

U.S. PATENT DOCUMENTS 3,177,095 A * 4/1965 Gibson ..... A47L 15/0089 134/183
2014/0360530 A1* 12/2014 Pers ..... A47L 15/0049 68/200
2016/0338566 A1* 11/2016 Shabtai ..... A47L 15/4234
2020/0214530 A1* 7/2020 Callahan ..... A47L 15/4463

* cited by examiner

*Primary Examiner* — Tinsae B Ayalew
(74) *Attorney, Agent, or Firm* — Morgan Law Offices, PLC

(57) ABSTRACT

A compact dishwasher for cleaning a few eating utensils includes a wash container disposed on a base. A clean water tank is disposed on the base and in fluid communication with the wash container for supplying clean water to the wash container. A wastewater tank is disposed on the base and in fluid communication with the wash container for receiving wastewater from the wash container. A housing body encompasses the wash container, the clean water tank, and the wastewater tank. The dishwasher can further comprise a first pump for facilitating pressurized discharge of clean water in the wash container and a second pump disposed for facilitating drainage of wastewater from the wash container into the wastewater tank. A heating coil can be employed to provide hot water to the wash container. The dishwasher can further include a cleaning basket insertable through the top of the dishwasher.

7 Claims, 19 Drawing Sheets

COMPACT DISHWASHER FOR CLEANING A FEW EATING UTENSILS

TECHNICAL FIELD

The present disclosure relates to dish washing in general. In particular, the present disclosure relates to a dishwasher that is compact and efficiently usable for washing only a small number of utensils.

BACKGROUND

Dishes and food utensils such as forks, spoons, and knives must be cleaned before reuse. This can be accomplished by hand washing or using a dishwasher. Hand washing involves manually scrubbing the dishes and food utensils with soapy water and rinsing them with water. Drying can be done using a towel or by simply air drying.

A dishwasher is a special-purpose machine in which items to be cleaned are placed therein. The items are cleaned using hot water and a special detergent. In the final cycle, the items are dried using hot air blowers. As between hand washing and using a dishwasher, most consumers prefer the latter since the set-up time and amount of work is much less.

However, a drawback to conventional dishwashers is that their use is an inefficient process when there are only a few items, such as a few eating utensils, to be cleaned. In cases where only a few food utensils need to be cleaned, it makes little sense to use a dishwasher. Moreover, for single-member households, college students living in a dorm, and those living in RVs or the like, a dishwasher may never be used.

SUMMARY

The present subject matter envisages a dishwasher system for cleaning a small number of eating utensils. The dishwasher system comprises a base. A wash container is disposed on the base. A clean water tank is disposed on the base and in fluid communication with the wash container for supplying clean water to the wash container. A wastewater tank is disposed on the base and in fluid communication with the wash container for receiving wastewater from the wash container. A housing body is configured for assembly with the base and for encompassing the wash container, the clean water tank, and the wastewater tank. Each of the wash container, the clean water tank, and the wastewater tank are freely removable for easy cleaning. The clean water tank is re-fillable with fresh water and the contents of the wastewater container can be disposed of in a sink or the like.

In accordance with a non-limiting embodiment of the present subject matter, the dishwasher system further comprises a first pump disposed operatively between the wash container and the clean water tank for facilitating pressurized discharge of clean water in the wash container.

In accordance with a non-limiting embodiment of the present subject matter, the dishwasher system further comprises a second pump disposed operatively between the wash container and the wastewater tank for facilitating drainage of wastewater from the wash container into the wastewater tank.

In accordance with a non-limiting embodiment of the present subject matter, the dishwasher system further comprises a cleaning basket for placement within the wash container for holding utensils therewithin to be washed.

In accordance with a non-limiting embodiment of the present subject matter, the dishwasher system further comprises a first window configured on the housing body for viewing a washing process within the cleaning basket.

In accordance with a non-limiting embodiment of the present subject matter, the dishwasher system further comprises a second window configured on the housing body for monitoring water level inside the clean water tank.

In accordance with a non-limiting embodiment of the present subject matter, the dishwasher system further comprises a water heater tank comprising a heater coil disposed therein, the water heater tank disposed downstream from the first water pump.

In accordance with a non-limiting embodiment of the present subject matter, the dishwasher system further comprises a nozzle base disposed in the wash container and in fluid communication with the water heater tank for receiving pressurized heated clean water therefrom, wherein clean water from the clean water tank is pumped into the water heater tank via the first pump for obtaining the heated clean water.

In accordance with a non-limiting embodiment of the present subject matter, the dishwasher system further comprises at least one sprayer configured for fitment on the nozzle base for spraying water into the wash container for facilitating washing of the utensils placed therewithin, wherein the sprayer is an elongate pipe having spray orifices configured thereon in a spaced apart configuration.

In accordance with a non-limiting embodiment of the present subject matter, the housing body has a compartmentalized configuration defined by a first wall and a second wall disposed in the housing body, wherein the first wall and the second wall together define a wash container compartment, a wastewater tank compartment, and a clean water tank compartment within the housing body.

In accordance with a non-limiting embodiment of the present subject matter, the dishwasher system further comprises a trim for placement on an operative top end of the housing body, the trim being configured to interface with a periphery of the housing body, the first wall, and the second wall.

In accordance with a non-limiting embodiment of the present subject matter, the dishwasher system further comprises a lid configured for fitment on the trim for covering the operative top end of the housing body.

In accordance with a non-limiting embodiment of the present subject matter, the cleaning basket can be freely removed from the wash container through an opening in the lid.

In accordance with a non-limiting embodiment of the present subject matter, the cleaning basket can be freely removed from the wash container through a hingeable opening in the lid to gain access thereto.

In accordance with a non-limiting embodiment of the present subject matter, the clean water tank can be freely removed by removing the lid to gain access thereto.

In accordance with a non-limiting embodiment of the present subject matter, the wastewater tank can be freely removed by removing the lid to gain access thereto.

DETAILED DESCRIPTION OF EXAMPLE EMBODIMENTS

Figure 1:
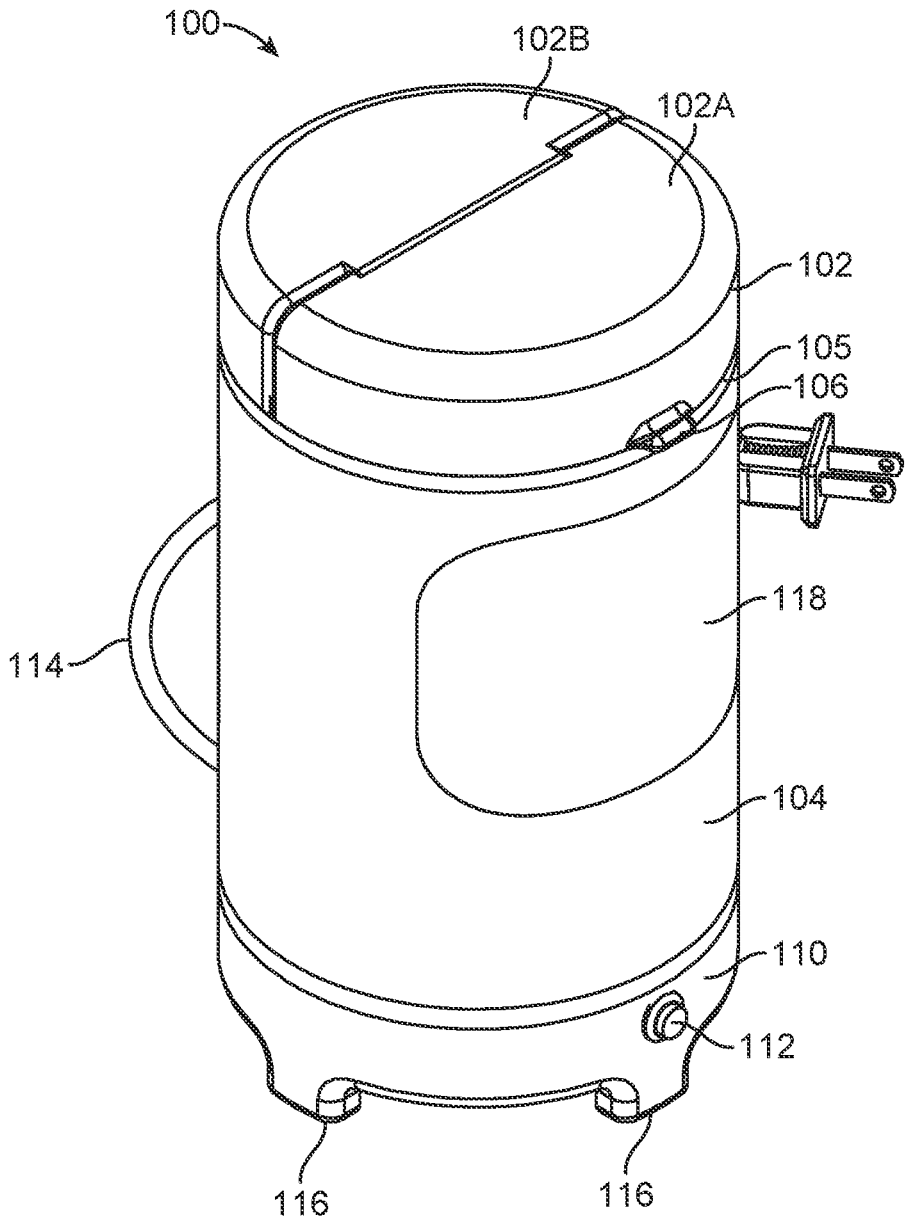
FIG. 1 through FIG. 12 illustrate various views of a dishwashing system, according to the first embodiment of the present invention.
Figure 2:
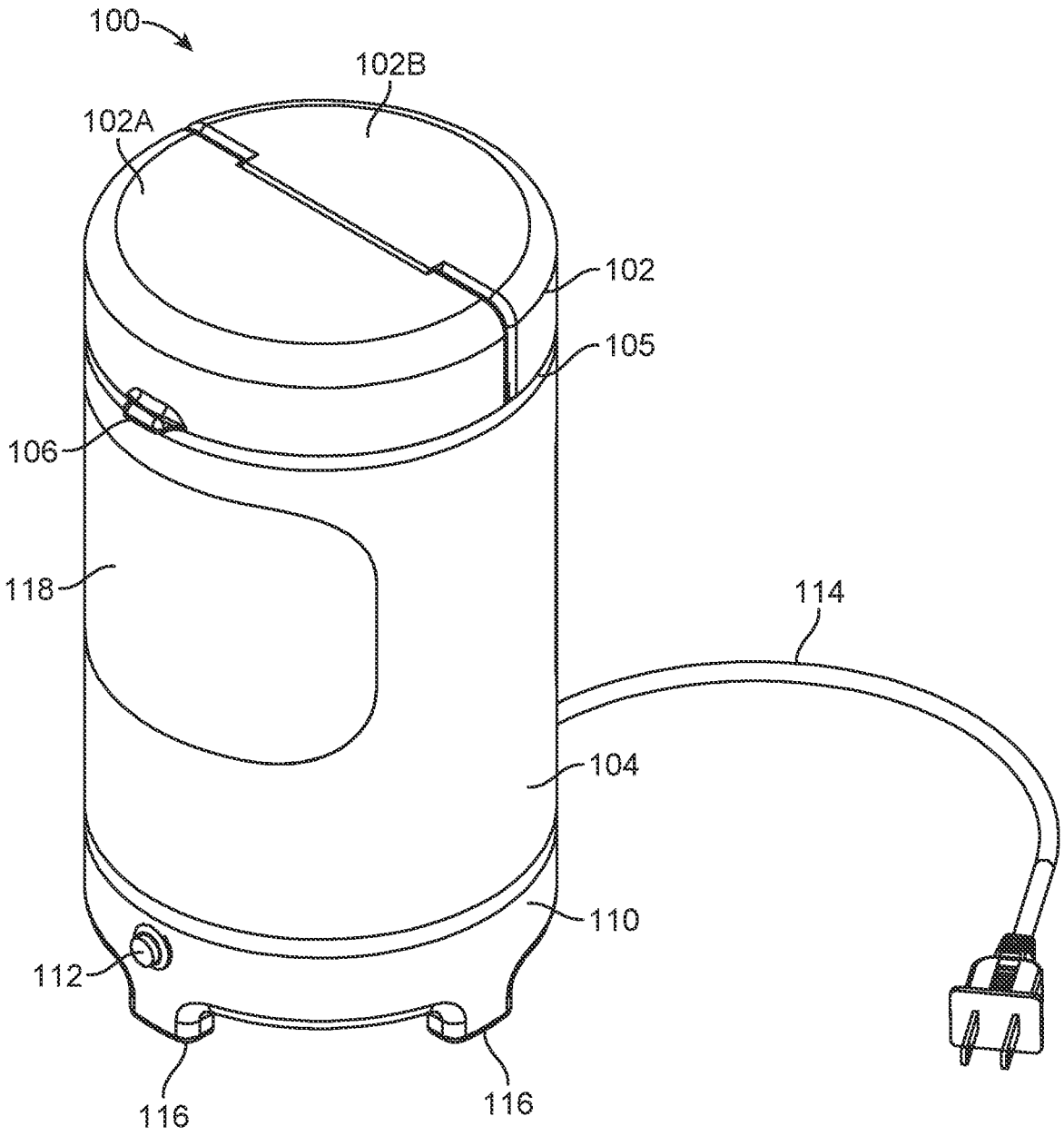

Example embodiments of the disclosure now will be described more fully hereinafter with reference to the accompanying drawings, in which example embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like elements but not necessarily the same or identical elements throughout.

Referring to FIG. 1 through FIG. 6, various views of a dishwashing system 100, according to the first embodiment of the present invention, are illustrated. The views depicted in FIG. 1 through FIG. 6 depict outer appearance of the dishwashing system 100 with a lid 102 of the dishwashing system 100 (hereinafter interchangeably referred to as system 100) in a closed configuration. As seen in FIG. 1 through FIG. 6, the system 100 comprises a housing body 104 wherein the lid 102 is fitted on a trim 105 covering the operative top end of the housing body 104.

Figure 8:
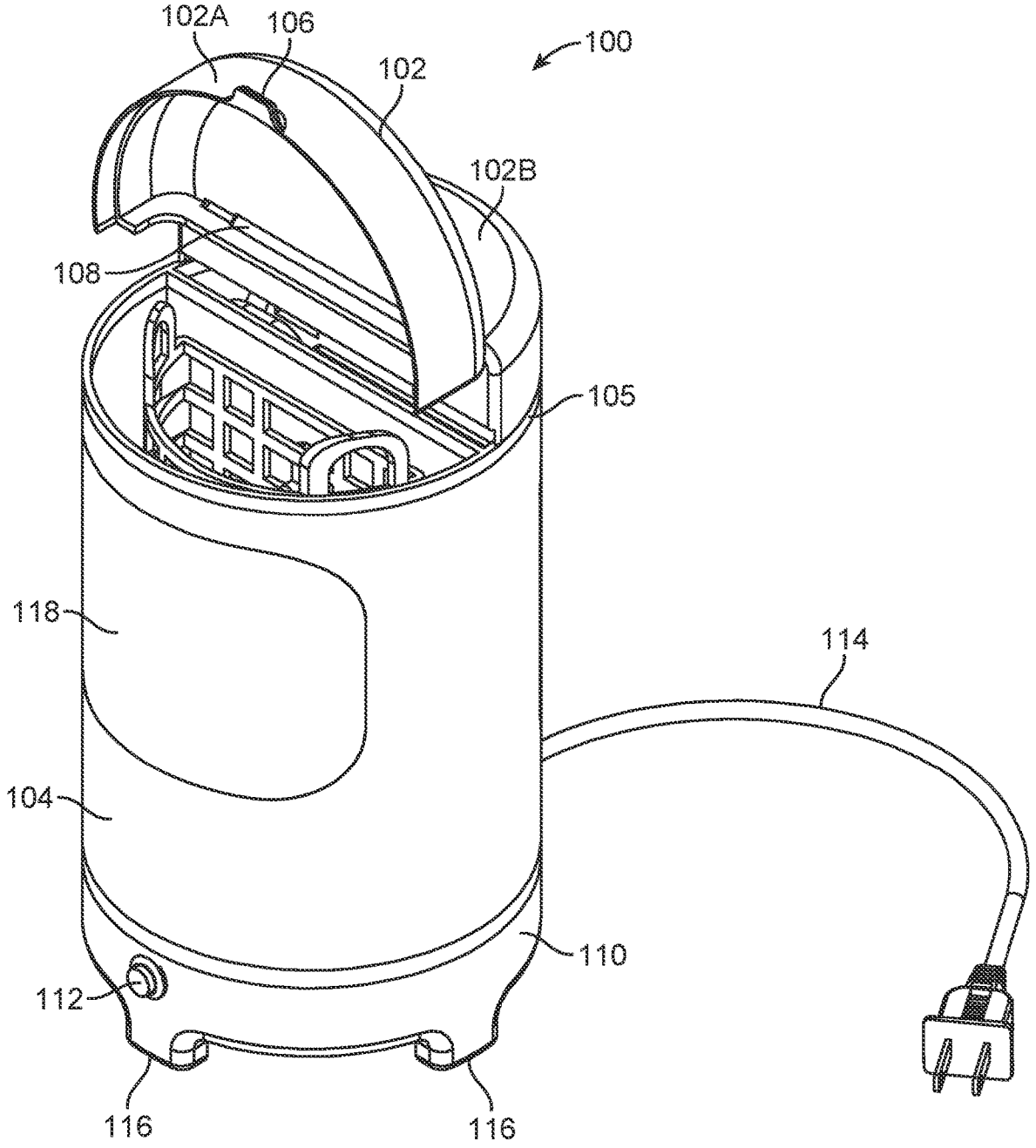
Figure 9:
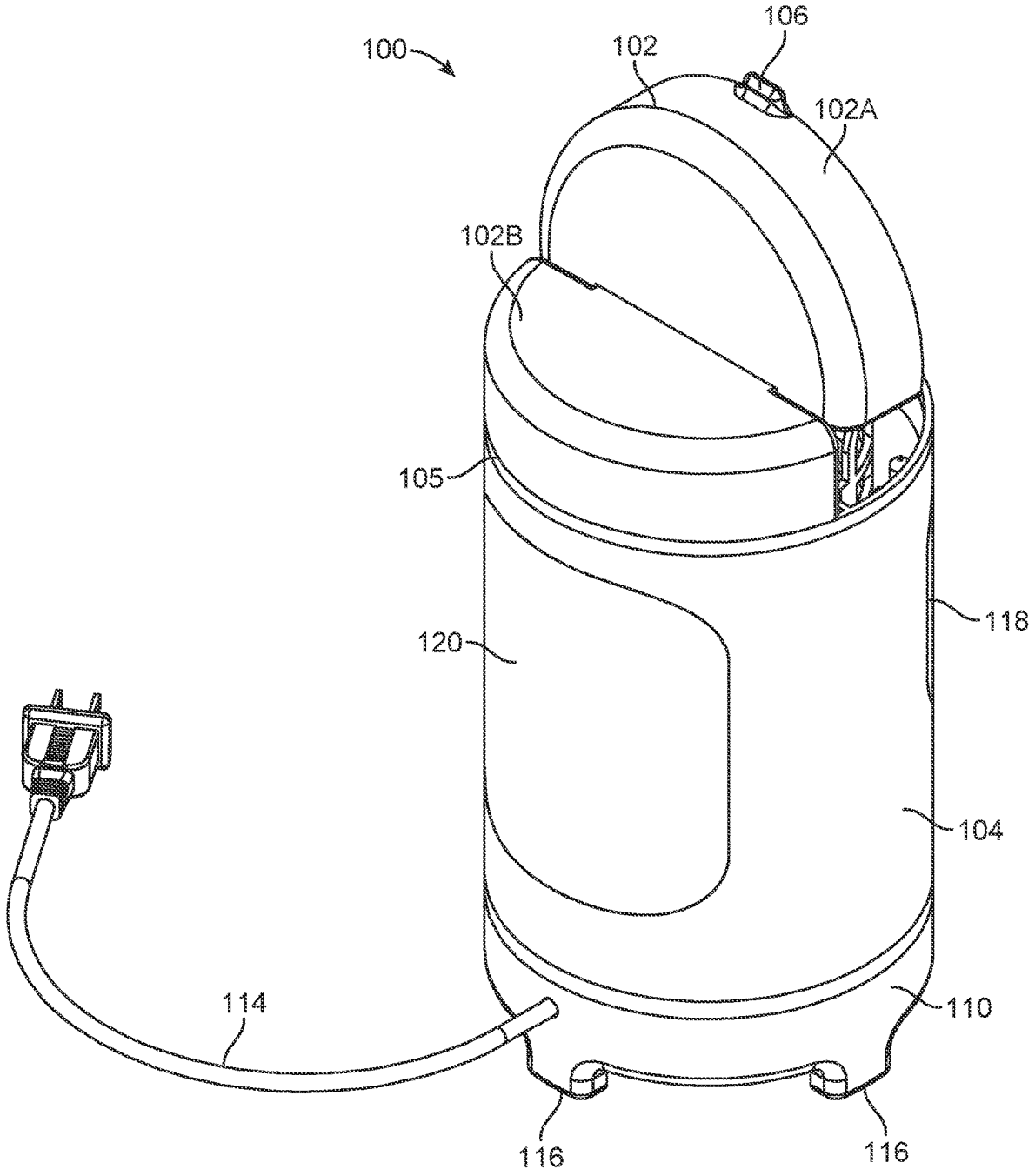
Figure 10:
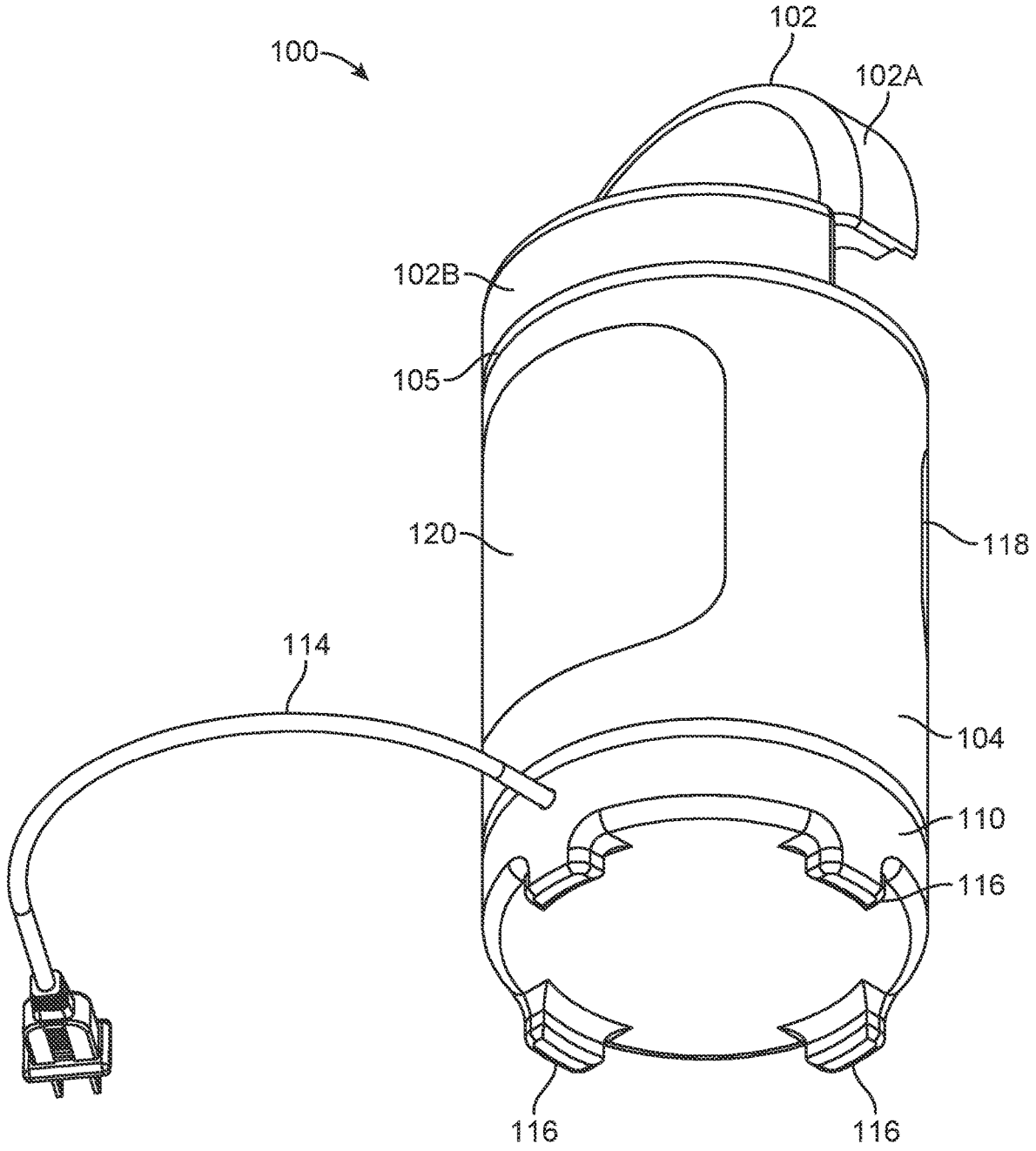
Figure 11:
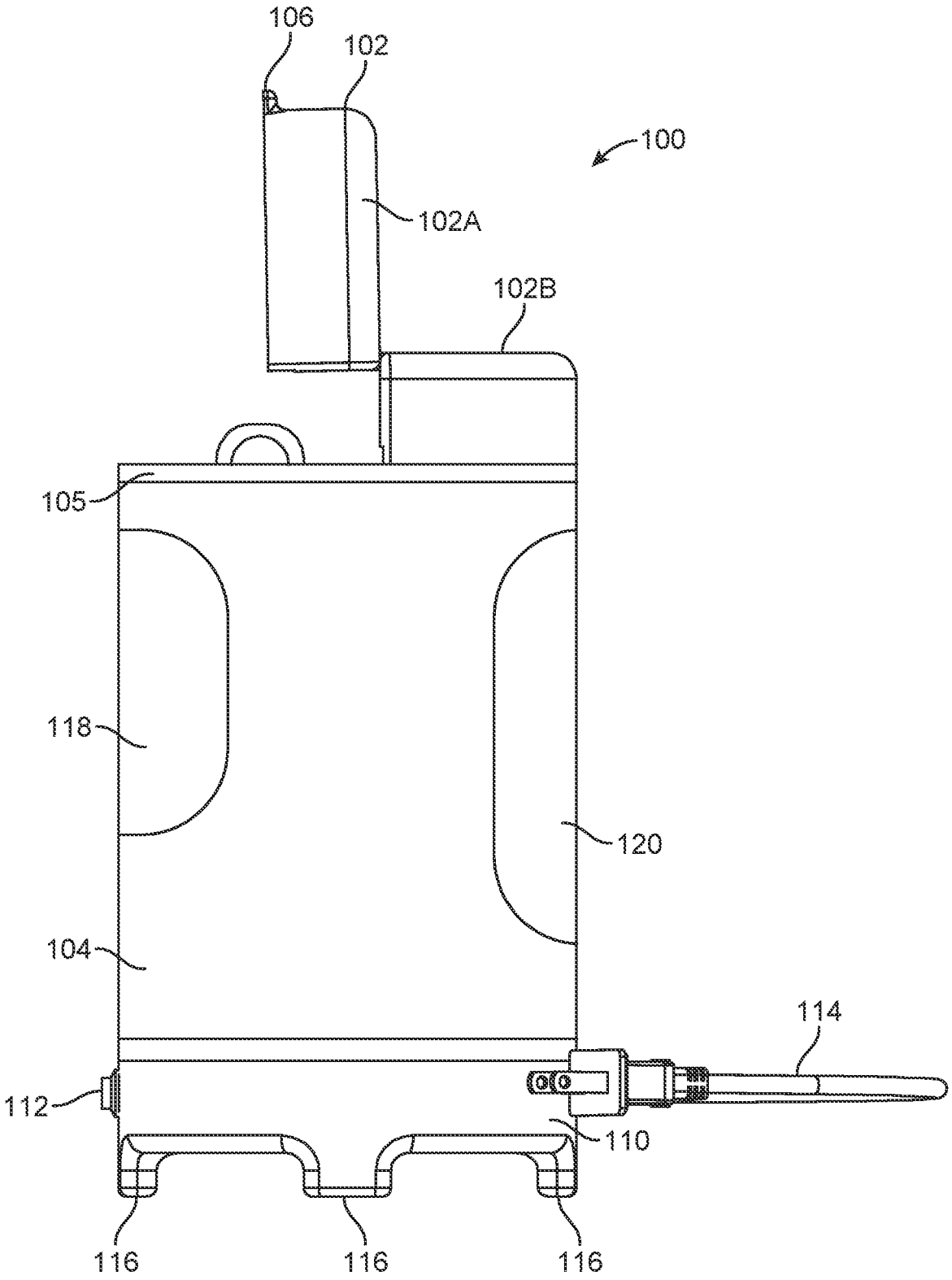
Figure 12:
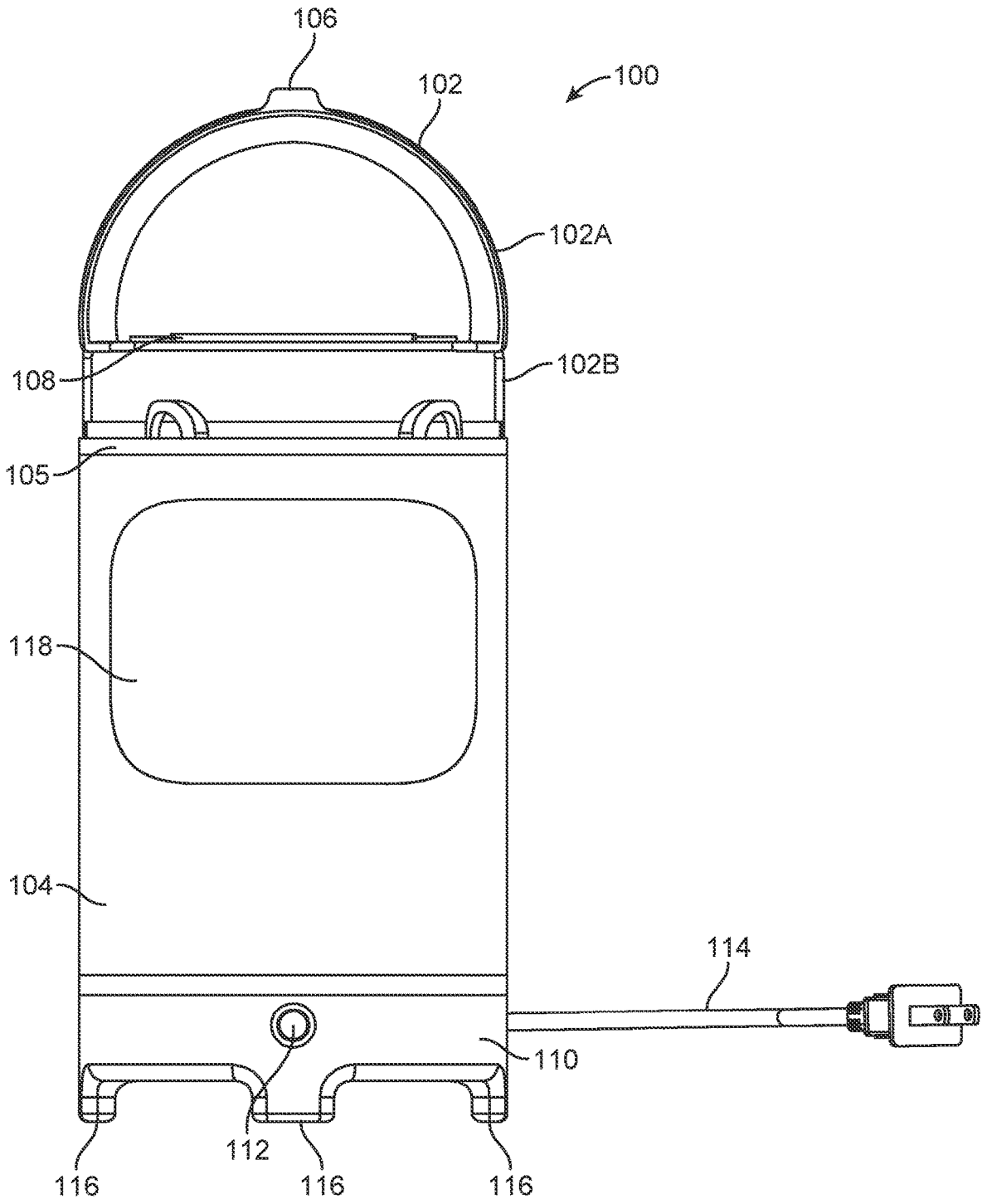

Referring to FIG. 1 through FIG. 6, the lid 102 includes a first section 102A and a second section 102B. The first section 102A and the second section 102B, each form portions of the lid 102. In the illustrated embodiment, the first section 102A of the lid 102 is coupled to the operative top end 104A by operation of a latch 106. In this embodiment, the second section 102B of the lid 102 is hingeably coupled to the first section 102A via a hinge 108 (depicted in FIG. 8) allowing the first section 102A to assume either an open or closed configuration.

In one embodiment, the system 100 further comprises a base 110. The base 110, in accordance with one embodiment, may have a hollow disc-like configuration that defines a space therewithin to house some of the components of the system 100. A power switch 112 and a power cord 114 may be provided on the base 110, in accordance with one embodiment of the present subject matter. In one embodiment, the base 110 may further include a plurality of legs 116, wherein the plurality of legs 116 may be configured with suction cups for secure placement of the system 100 over a flat surface. Other means for facilitating secure placement of the system 100 on flat surfaces, e.g., usage of adhesive tapes, are well within the ambit of the present invention.

Figure 3:
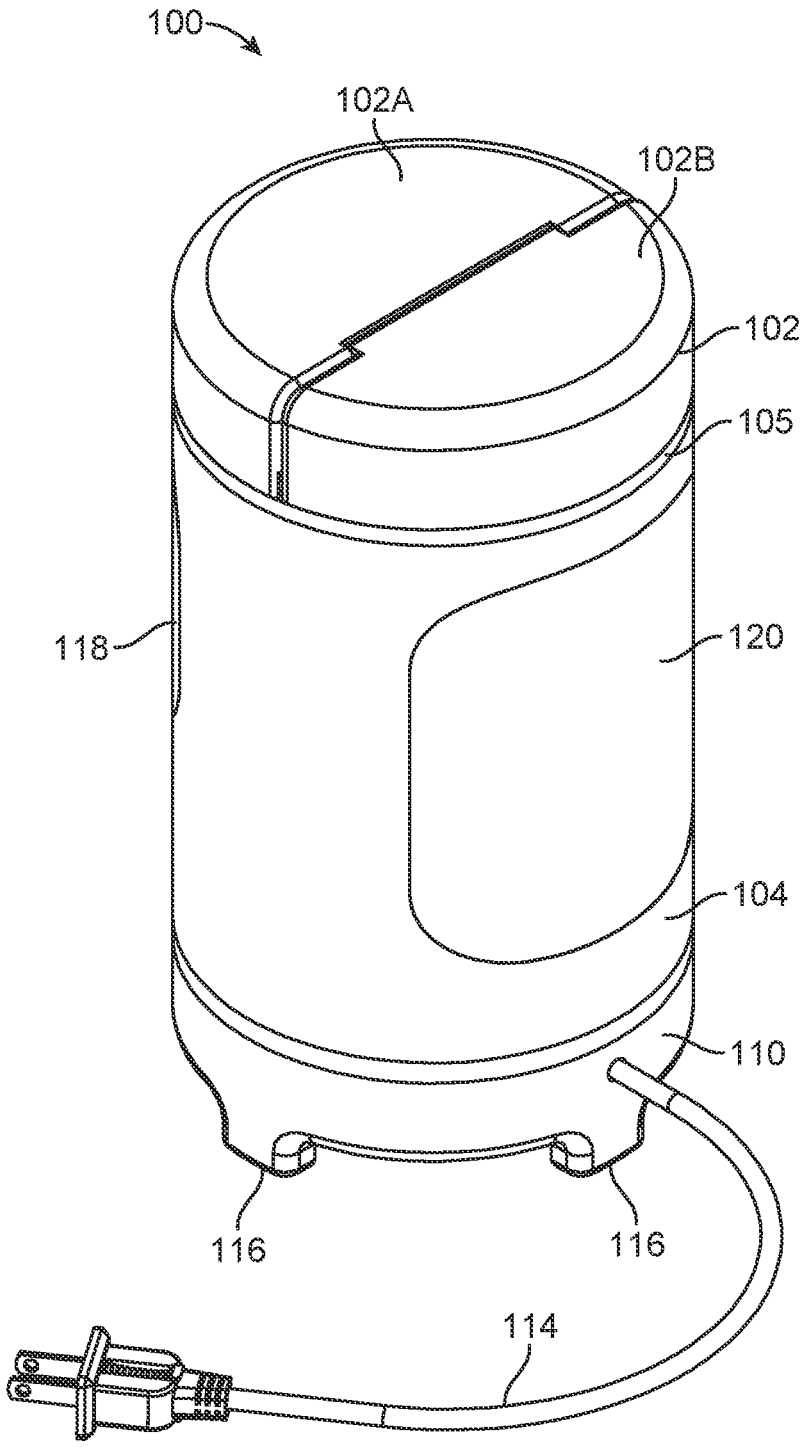
Figure 4:
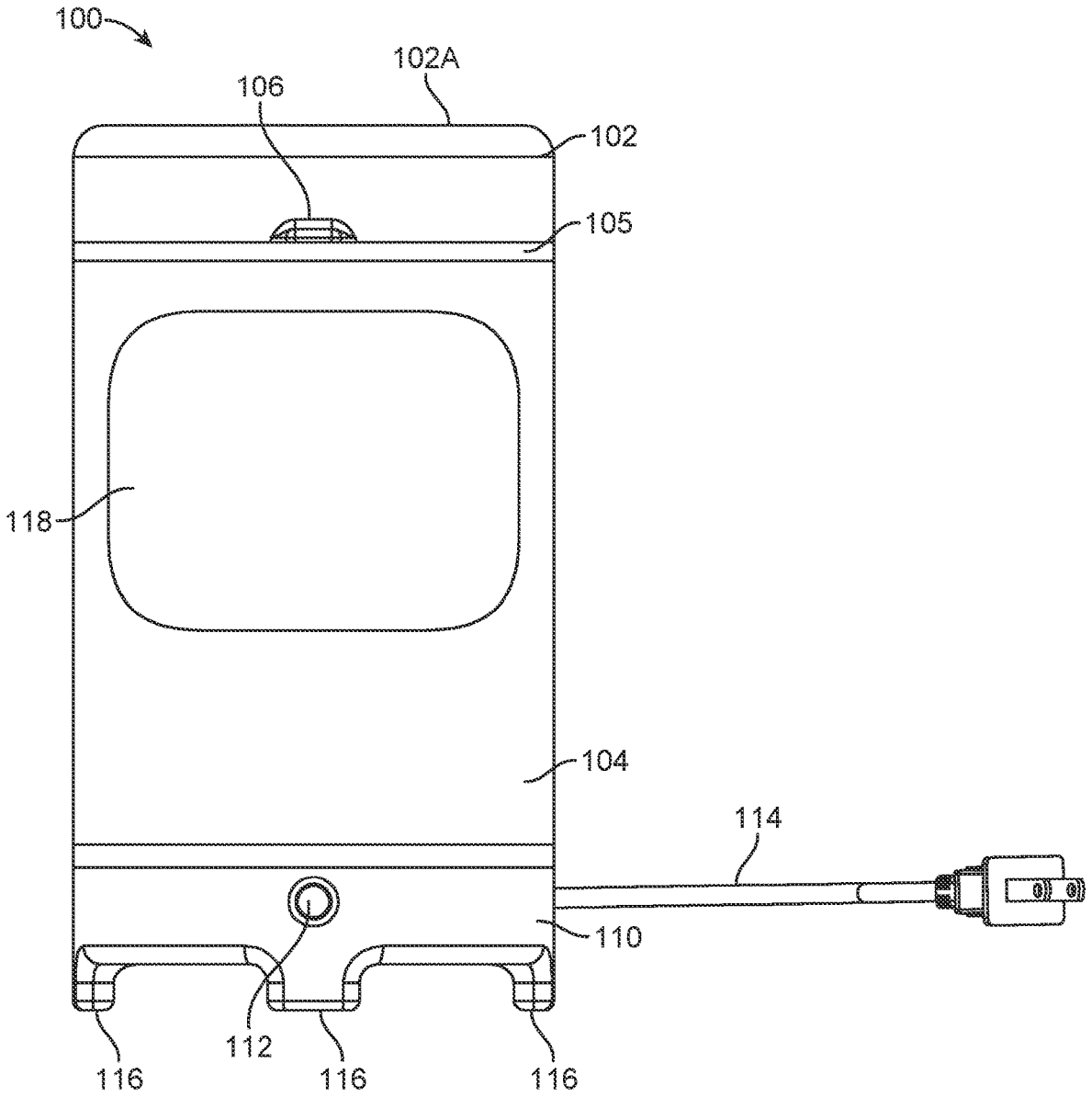
Figure 5:
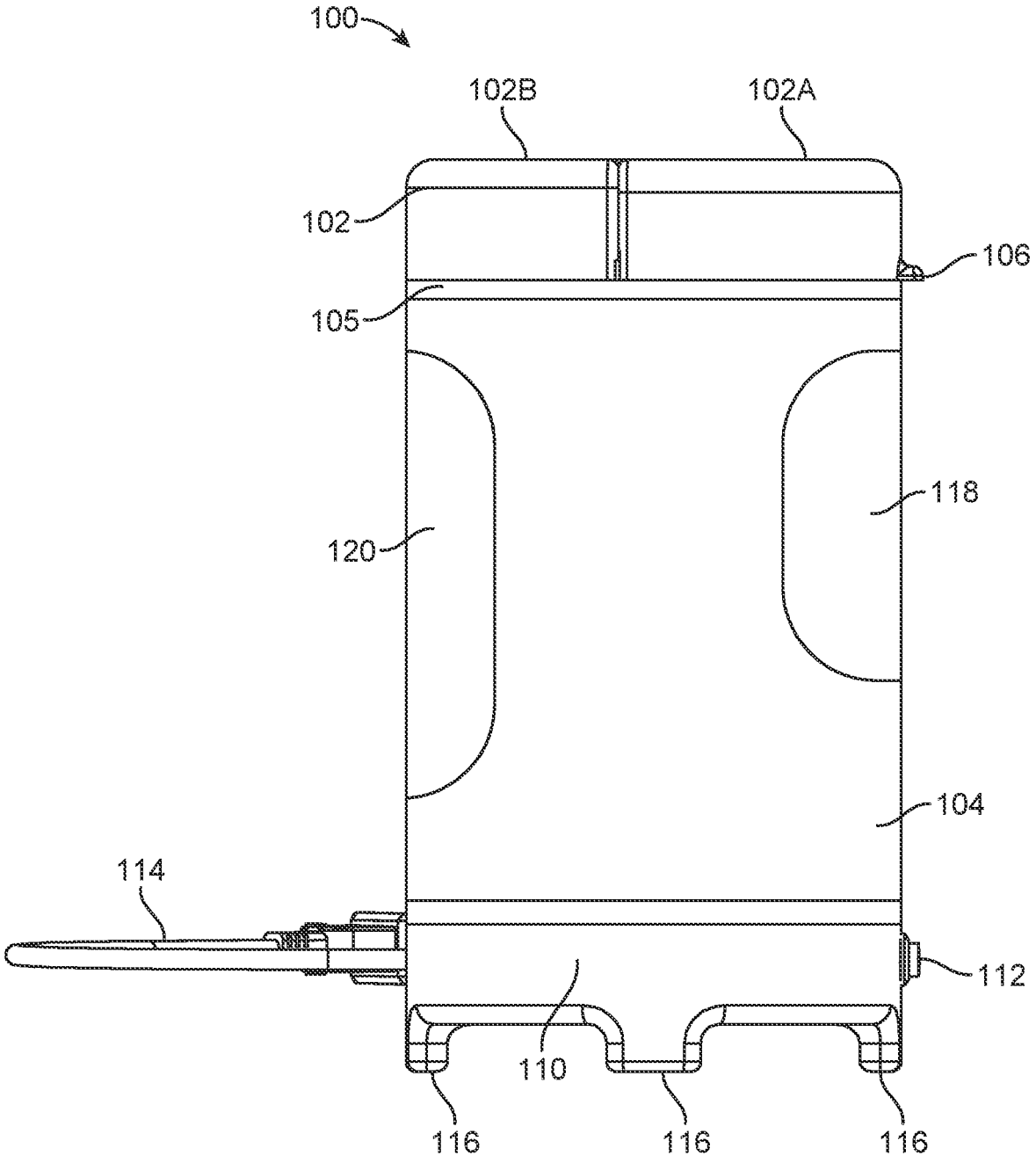
Figure 6:
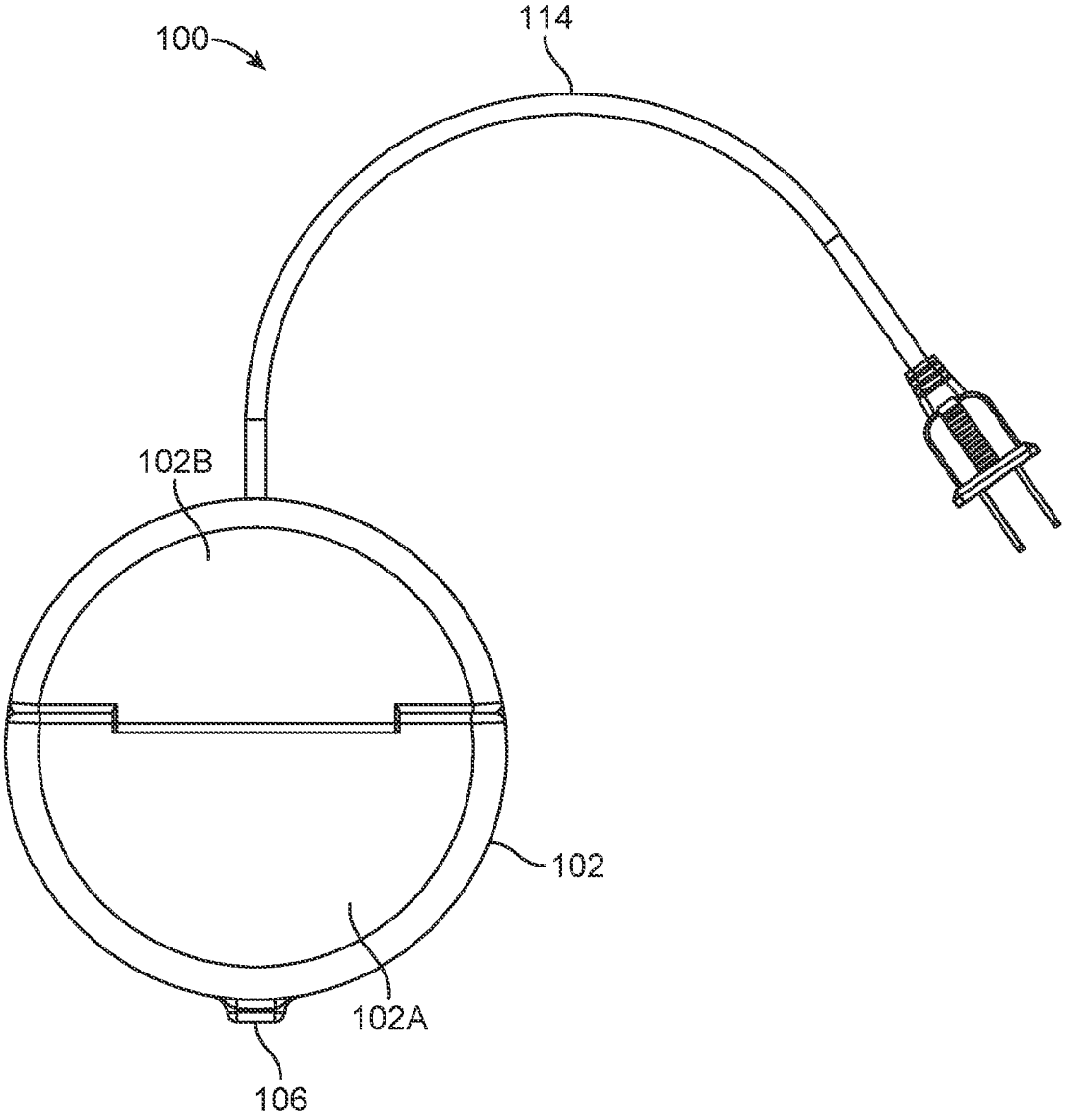
Figure 7:
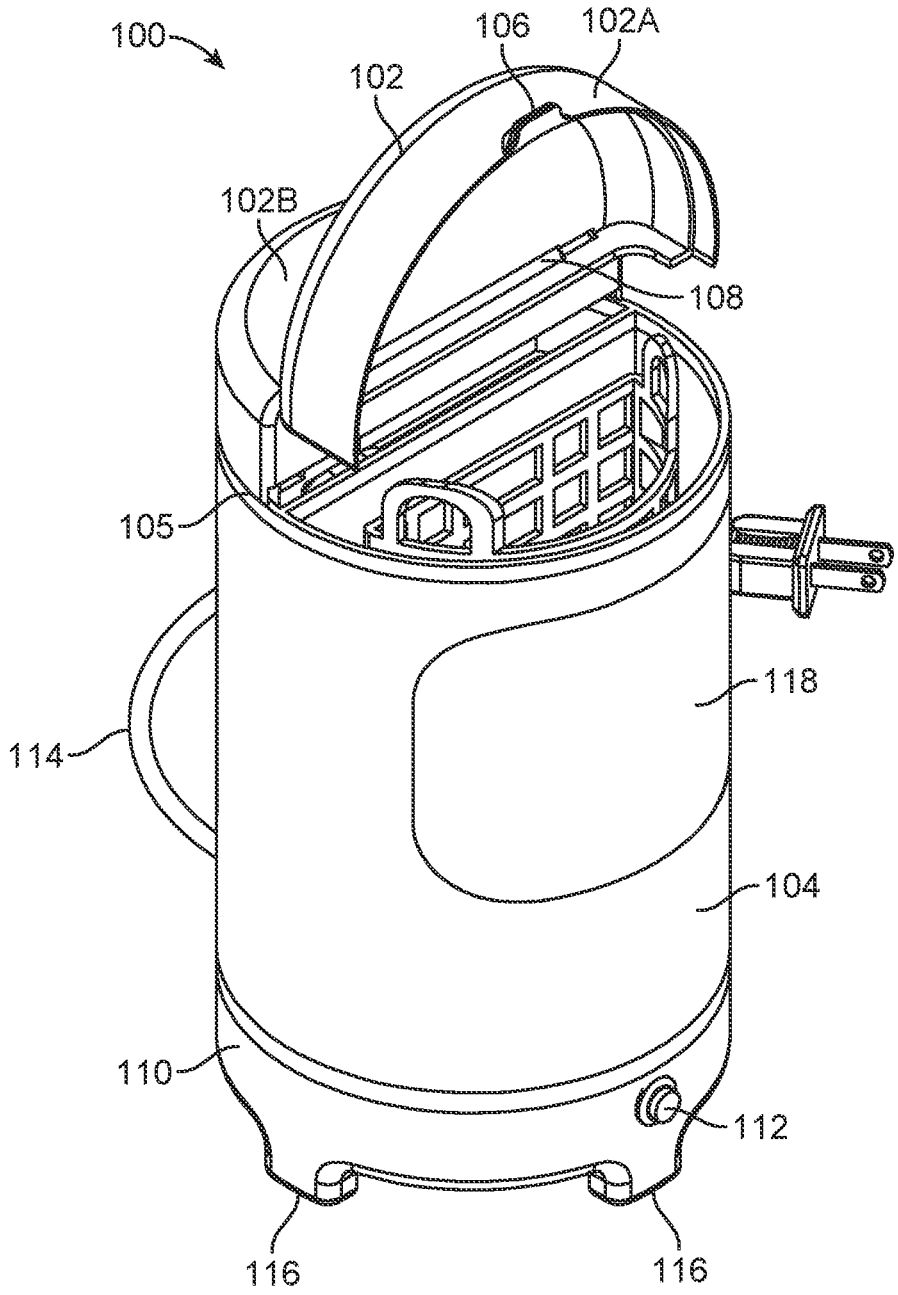

The system 100 further comprises a first window 118 and a second window 120 (as seen in FIG. 3) provided on the housing body 104. The first and second windows 118, 120 allow the user to observe the interior of the housing body 104 to monitor the washing process within the dishwashing system 100.

Referring to FIG. 7 through FIG. 12, different views of the system 100 are depicted with the second section 102B of the lid 102 in an open configuration thereof, according to the first embodiment of the present invention. As mentioned previously, the second section 102B of the lid 102 is hingeably coupled to the first section 102A via the hinge 108.

Figure 13:
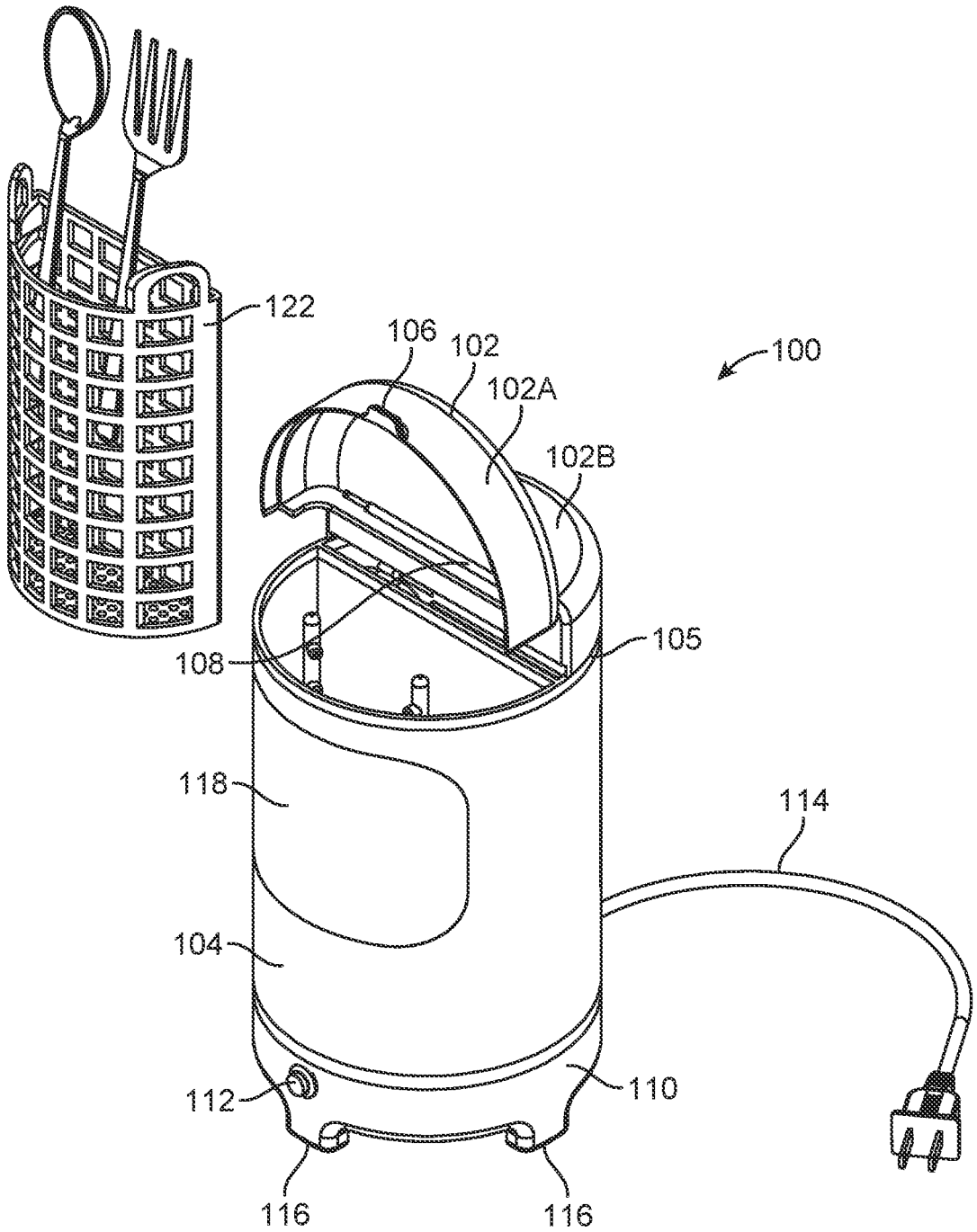
FIG. 13 through FIG. 17 illustrate various views of the dishwashing system depicting inner components thereof, according to the first embodiment of the present invention.
Figure 14:
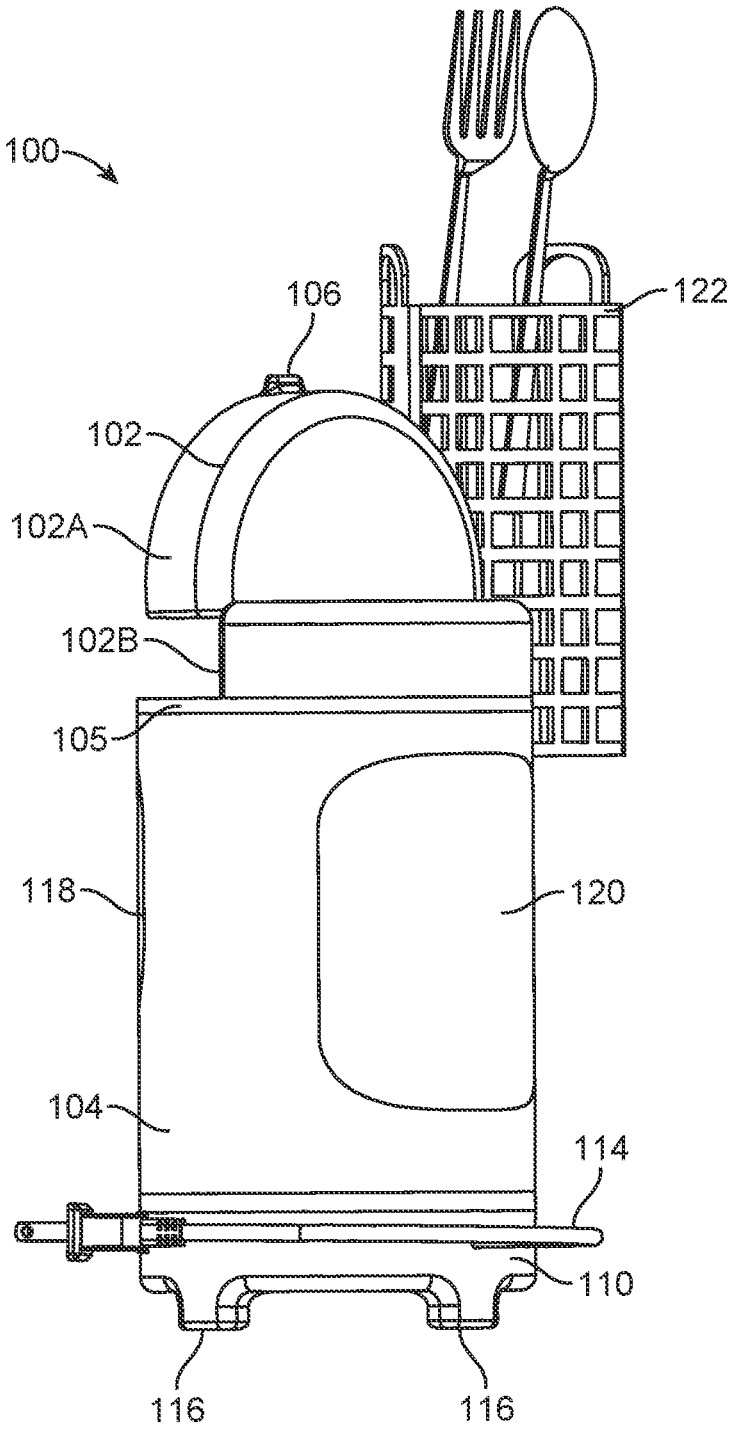
Figure 15:
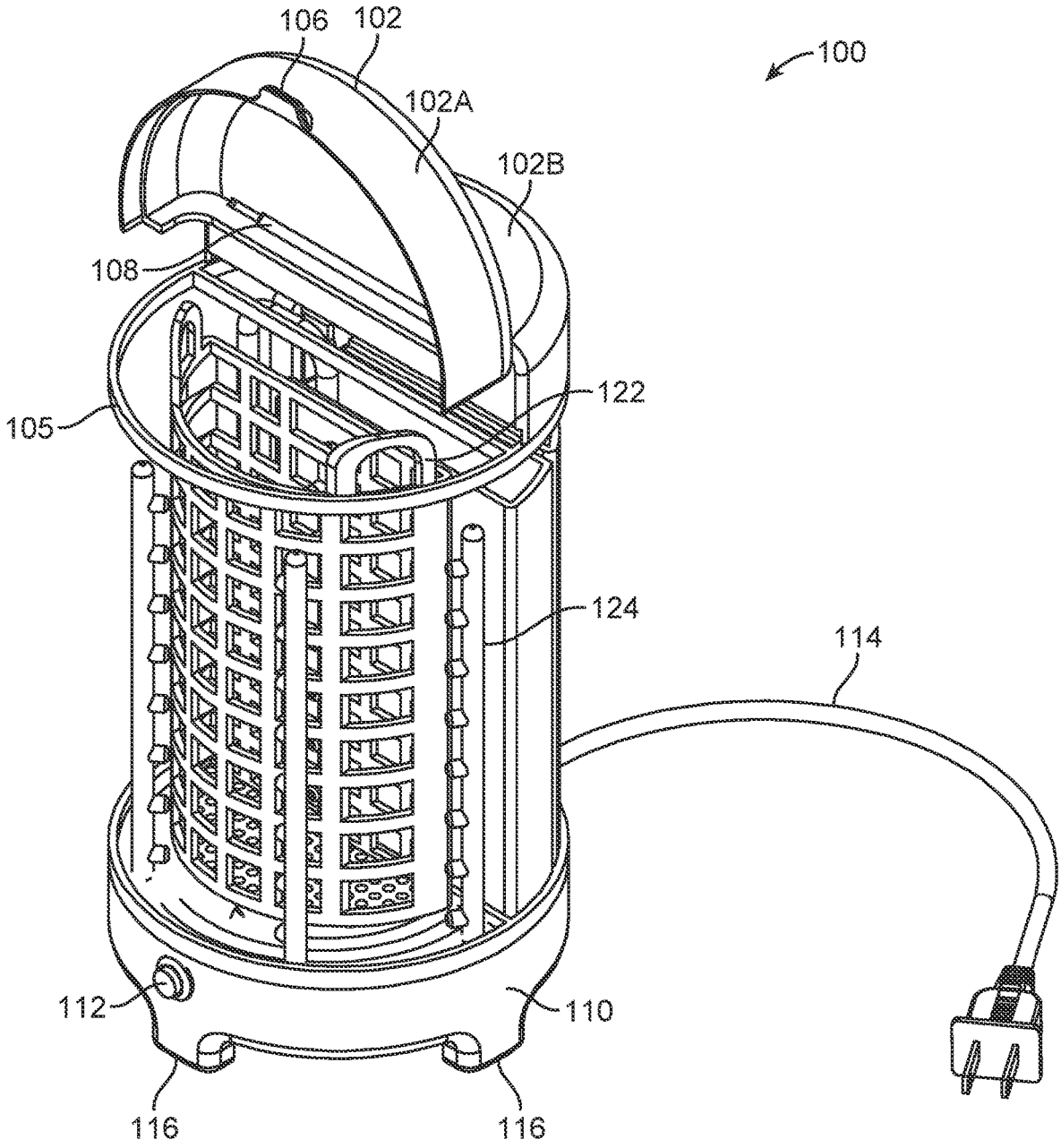
Figure 16:
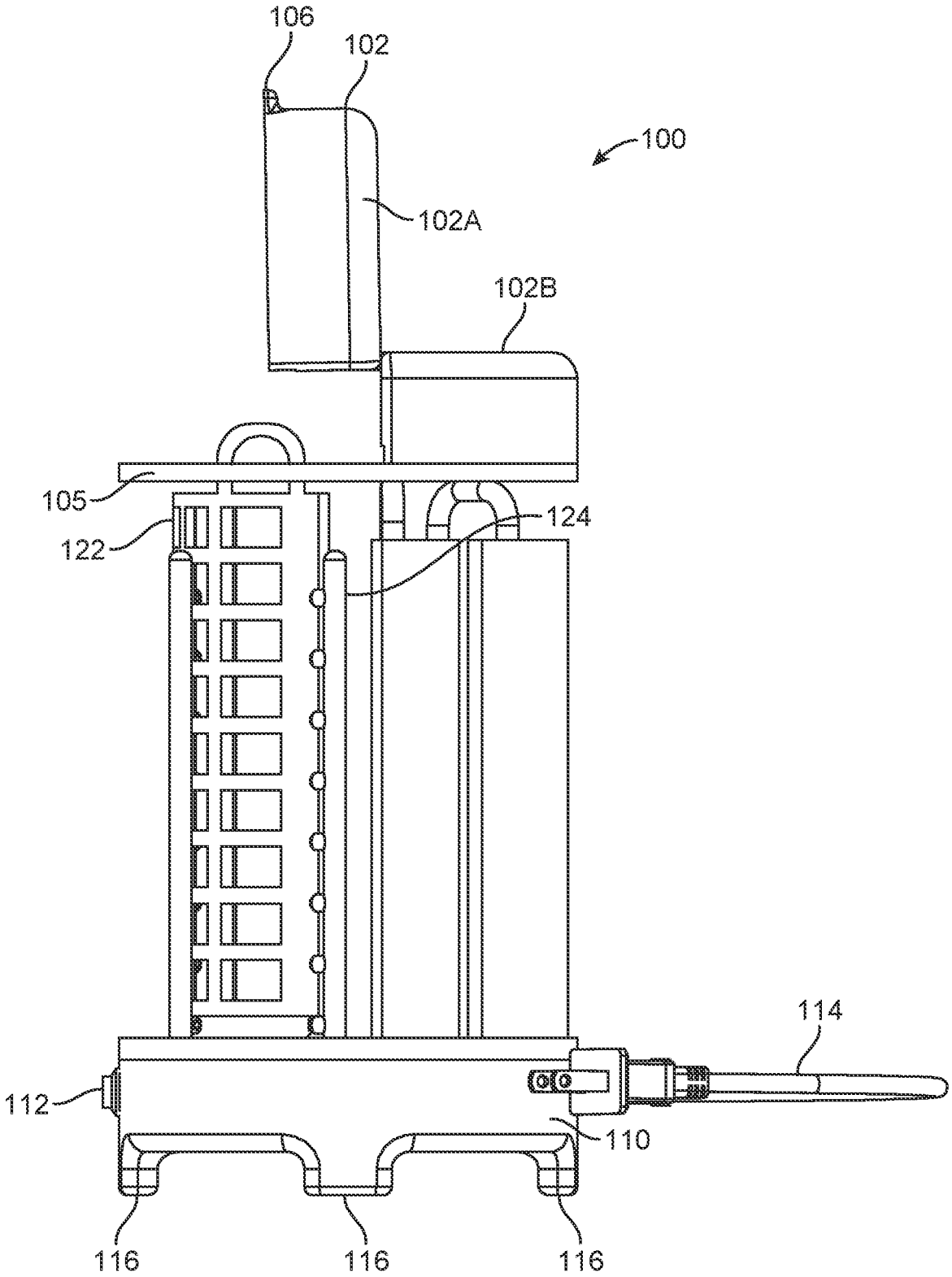
Figure 17:
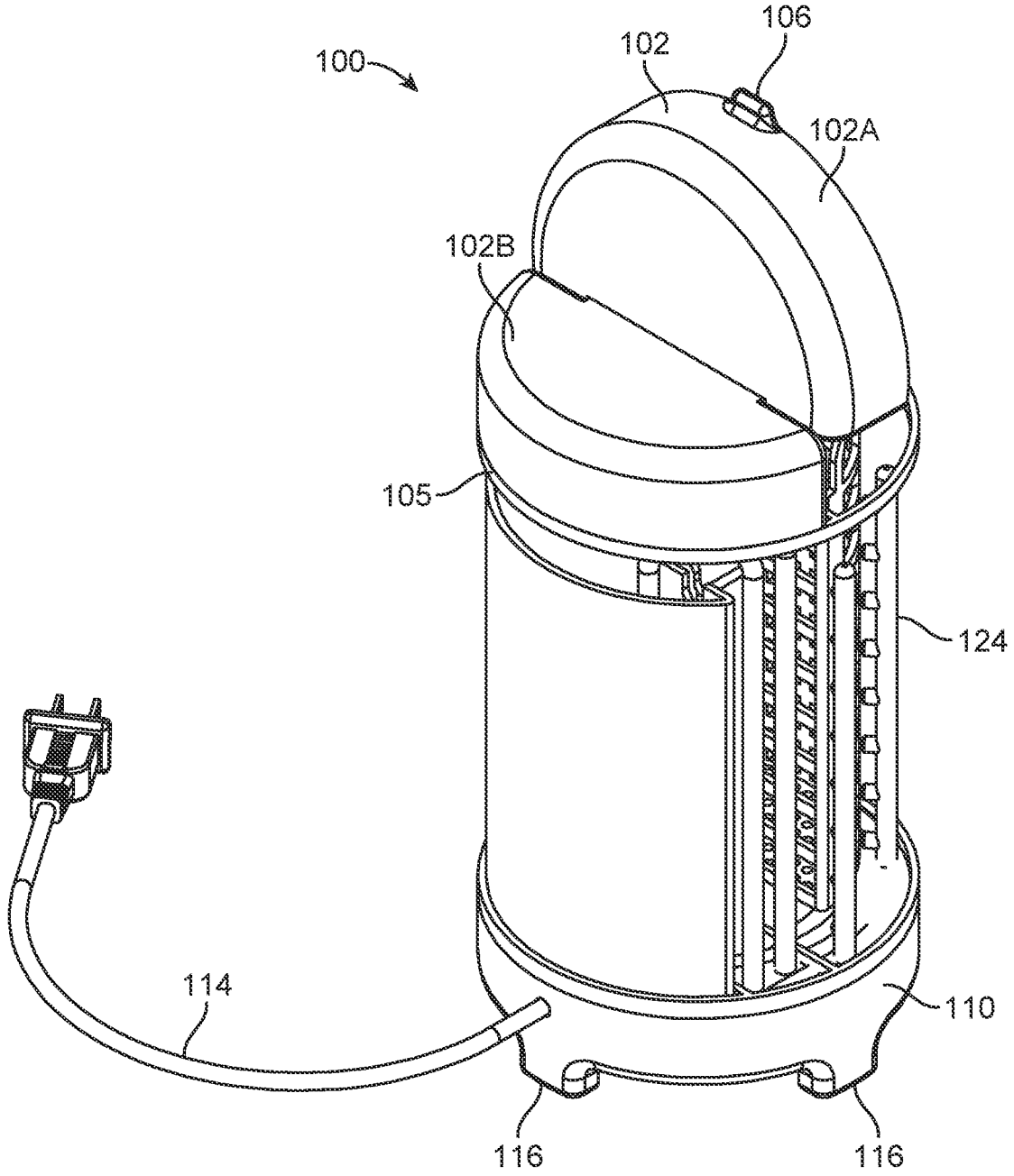

Referring to FIG. 13 through FIG. 17, different views of the dishwashing system 100 depicting inner components thereof are depicted, according to the first embodiment of the present invention. As seen in FIG. 13, the system 100 comprises a cleaning basket 122. In accordance with one embodiment of the present invention, the cleaning basket 122 may have a net-like design. The utensils to be washed are placed inside the cleaning basket 122, and the cleaning basket 122 in turn is inserted within the housing body 104 through an opening in the lid 102. The housing body 104 includes a nozzle and spray arrangement 124 that facilitates the washing of the utensils placed within the cleaning basket 122 due to its net-like design. The hinge 108 allows the user to lift the first section 102A of the lid 102 open for inserting therein the cleaning basket 122. The specific configuration of the interior of the housing body 104 and the different components and operation of the system 100 are described elaborately in the subsequent sections of the present disclosure.

Figure 18:
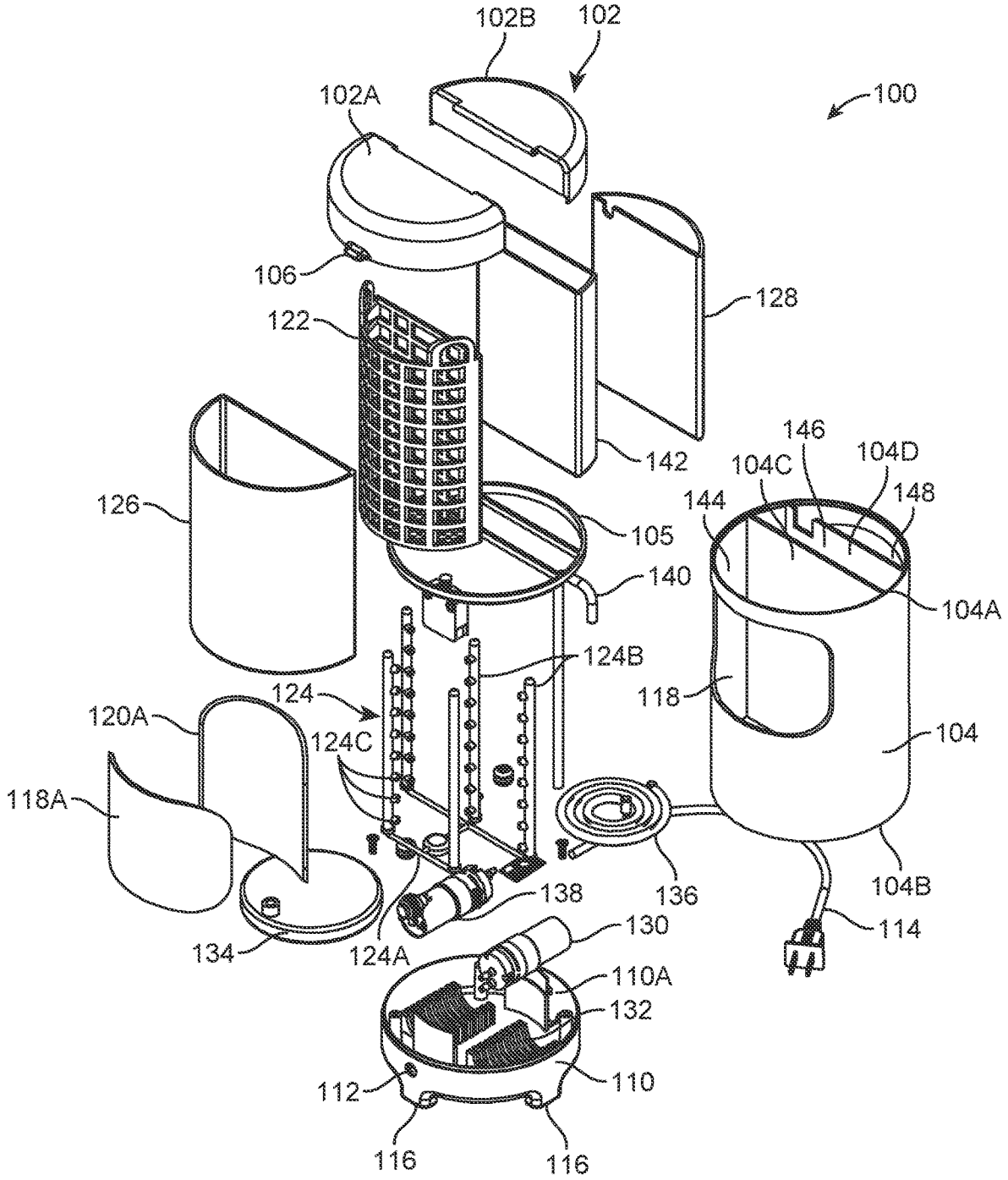
FIG. 18 illustrates an exploded view of the dishwashing system depicting the different components of thereof, according to the first embodiment of the present invention.

Referring to FIG. 18, an exploded view of the dishwashing system 100 is illustrated, according to the first embodiment of the present invention. All the different components of the dishwashing system 100, according to the first embodiment of the present invention, can be seen in FIG. 18. The construction of the system 100 is hereinafter described with reference to FIG. 18. In one embodiment, the system 100 comprises a wash container 126 that is disposed on the base 110. More specifically, the wash container 126 is configured for placement within the housing body 104, and the cleaning basket 122 is then placed inside the wash container 126. The utensils to be washed may be placed inside the cleaning basket 122, which may then be placed inside the wash container 126.

The system 100 further comprises a clean water tank 128 that is disposed on the base 110 and in fluid communication with the wash container 126 for supplying clean water to the wash container 126. It is to be noted that for performing the washing operation on the utensils, pressurized and heated clean water is required to be supplied to the wash container 126. Therefore, for providing the required pressurization of the clean water, the system 100 comprises a first pump 130 that is placed within the base 110. As mentioned previously, the base 110 has a hollow disc-like configuration for housing some components of the dishwasher system 100 therein. The base 110 defines an interior space 110A within which the first pump 130 may be placed. In one embodiment, a pump support structure 132 may be provided within the base 110 for securely supporting the first pump 130 thereon. The first pump 130 is in fluid communication with the clean water tank 128 for receiving the clean water therefrom for pressurization.

The system 100 further comprises a water heater tank 134 comprising a heater coil 136 disposed therein. The water heater tank 134 is disposed downstream from the first pump 130 for receiving the pressurized clean water therefrom. The water heater tank 134 and the heater coil 136 facilitate the heating of the pressurized water, thereby providing the pressurized and heated clean water required for washing of utensils. The water heater tank 134 is in fluid communication with the nozzle and spray arrangement 124. The nozzle and spray arrangement 124 is disposed inside the wash container 126, within which is also placed the cleaning basket 122.

In one embodiment, the nozzle and sprayer arrangement 124 comprises a nozzle base 124A disposed in the wash container 126 and in fluid communication with the water heater tank 134 for receiving pressurized heated clean water therefrom. More specifically, the nozzle base 124A is a piping component that includes a small network of horizontally arranged pipes or tubes having a plurality of nozzles configured thereon. The nozzle and sprayer arrangement 124 further comprises at least one sprayer 124B configured for fitment on the nozzle base 124A for spraying water into the wash container 126 for facilitating washing of the utensils placed therewithin. More specifically, the sprayers 124B are fitted on the nozzles configured on the nozzle base 124A and extend vertically upwards. In one embodiment, the sprayer 124B may be an elongate pipe having spray orifices 124C configured thereon in a spaced apart configuration for facilitating sprayed discharge of heated pressurized clean water onto the utensils placed within the cleaning basket 122. The wastewater resulting from the washing of the utensils in the wash container 126 is collected inside the wash container 126, in accordance with one embodiment of the present invention.

To remove the wastewater from the wash container 126, the system 100 further comprises a second pump 138. The second pump 138 may be in fluid communication with the wash container 126 for facilitating the drainage of the wastewater collected inside the wash container 126. In one embodiment, the system 100 further comprises a drainpipe 140 in fluid communication with the second pump 138. The system 100 further comprises a wastewater tank 142 disposed on the base 110 adjacent the clean water tank 128 and in fluid communication with the wash container 126 via the second pump 138 and the drainpipe 140 for receiving wastewater from the wash container 126.

The housing body 104 is configured for assembly with the base 110 and for encompassing the wash container 126, the clean water tank 128, and the wastewater tank 142. More specifically, the housing body 104 has a compartmentalized configuration defined by a first wall 104C and a second wall 104D disposed in the housing body 104. The first wall 104C and the second wall 104D together define a wash container compartment 144, a wastewater tank compartment 146, and a clean water tank compartment 148 within the housing body 104 between the operative top end 104A and operative bottom end 104B.

In accordance with an embodiment of the present subject matter, the dishwasher system 100 further comprises the first window 118 configured on the housing body 104 for viewing a washing process within the cleaning basket 122. More specifically, a first transparent pane 118A is fitted into the first window 118 to allow visibility into the cleaning basket 122 to monitor the washing of the utensils. The dishwasher system further comprises the second window 120 (as seen in FIG. 3) configured on the housing body 104 for monitoring water level inside the clean water tank 128. More specifically, a second transparent pane 120A is fitted into the second window 120 to allow visibility into the clean water tank 128 for monitoring the level of clean water available therein.

In accordance with an embodiment of the present subject matter, the dishwasher system 100 further comprises the trim 105 for placement on an operative top end 104A of the housing body 104. The trim 105 may be configured to interface with a periphery of the operative top end 104A of the housing body 104, the first wall 104C, and the second wall 104D. The lid 102 is configured for fitment on the trim 105 for covering the operative top end 104A of the housing body 104. The trim 105 may function as a gasket, according to an embodiment of the present invention.

In accordance with a non-limiting embodiment of the present invention, the entire dishwasher (referred to herein as the dishwashing system 100) is no taller than about 18 inches in height.

In accordance with a non-limiting embodiment of the present subject matter, the cleaning basket 122 can be freely removed from the wash container 126 through an opening in the lid.

In accordance with a non-limiting embodiment of the present subject matter, the cleaning basket 122 can be freely removed from the wash container 126 through by opening the first section 102A of the lid 102 to gain access thereto, then by lifting.

In accordance with a non-limiting embodiment of the present subject matter, the clean water tank 128 can be freely removed by removing the lid 102 to gain access thereto, then by lifting.

In accordance with a non-limiting embodiment of the present subject matter, the wastewater tank 142 can be freely removed by removing the lid to gain access thereto, then by lifting.

It is to be understood that the term freely removed means that the item to be removed is lifted along a path free of obstruction. In the first embodiment, the item to be removed is seated on the base 110 via a friction fit and the removal path includes only an air space within the base 104 extending through a top opening in the base 104. In some cases (such as when removing the clean water tank 128 and/or the wastewater tank 142), the lid 102 will have to be first removed.

Figure 19:
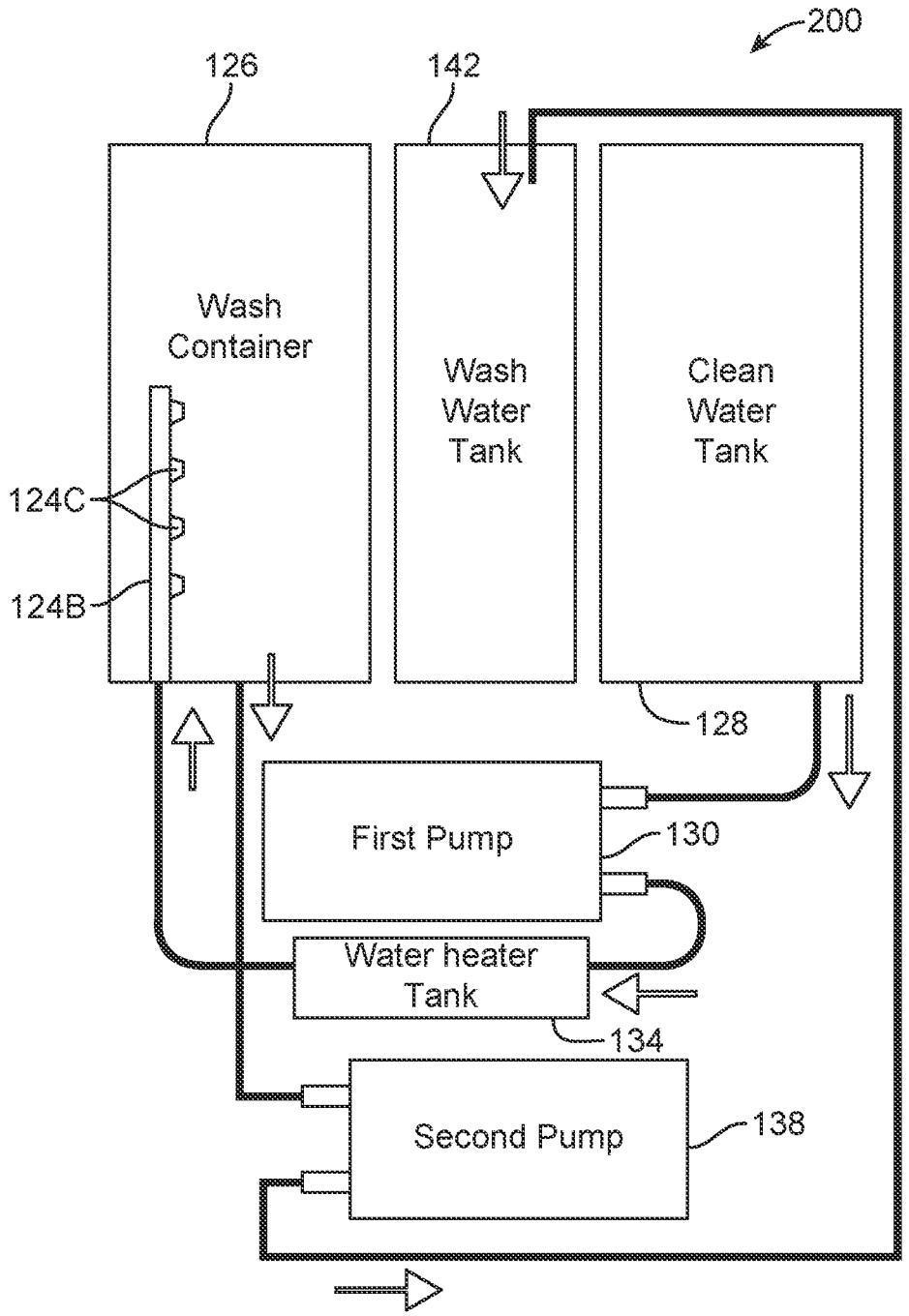
FIG. 19 illustrates a block diagram depicting the operation of the dishwashing system, according to the first embodiment of the present invention.

Referring to FIG. 19, a block diagram 200 depicting the operation of the dishwashing system 100 according to the first embodiment of the present invention, is illustrated. The utensils to be washed are placed inside the wash container 126 within the cleaning basket 122 placed therewithin. The washing of the utensils is performed via hot pressurized water. Therefore, clean water from the clean water tank 128 is then pressurized via the first pump 130 and heated via the water heater tank 134 before being supplied into the wash container 126 via the sprayer 124B and the spray orifices 124C. The second pump 138 is in fluid communication with the wash container 126 to receive the wastewater from the wash container 126 and pump the same into the wastewater tank 142. In accordance with one embodiment, the operation of the first pump 130, the second pump 138, the water heater tank 134, may be governed by a control unit. Furthermore, the control unit may further be configured to be coupled to an interface unit for making the system 100 as interactive as possible for the user. Example of such interfaces may include a touch sensitive display, voice command capabilities, and the like.

In accordance with an embodiment, heating of water used in the wash container 126 is accomplished by the user adding by hand pre-heated hot water into the clean water tank 128. In still other embodiments, the water used in the wash container 126 would not be heated. In these cases, the water heater tank 134 and the heater coil 136 would not be included (or could be optional). In still other embodiments, a detergent or soap could be added either by hand or using a built-in soap dispenser. The detergent or soap is added, directly or indirectly, to the wash container 126.

It is to be noted that all the joints and locations within the system 100 that interact with either clean water or wastewater are provided with leakage prevention means such as gaskets, seals, and the like as applicable to ensure the prevention of water leakage therefrom.

An advantageous aspect of the system 100, in accordance with the present subject matter, is the compact design and configuration of the system 100. The compactness of the system 100 contributes to its portability and ease of usage in temporary residences such as campsites, recreational vehicles, and the like. Furthermore, the system 100 is a convenient and cost-saving alternative to the conventional bulky dishwashing systems for individuals who live alone.

Although the features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A dishwasher system comprising:

a base;

a wash container disposed on the base;

a clean water tank disposed on the base and in fluid communication with the wash container for supplying clean water to the wash container;

a wastewater tank disposed on the base and in fluid communication with the wash container for receiving wastewater from the wash container;

a cylindrical housing body configured for assembly with the base and for encompassing the wash container, the clean water tank, and the wastewater tank;

a first pump disposed operatively between the wash container and the clean water tank for facilitating pressurized discharge of clean water in the wash container;

a second pump disposed operatively between the wash container and the wastewater tank for facilitating drainage of wastewater from the wash container into the wastewater tank;

a nozzle base disposed in the wash container and in fluid communication with the water heater tank for receiving pressurized heated clean water therefrom, wherein clean water from the clean water tank is pumped into the water heater tank via the first pump for obtaining the heated clean water;

at least one sprayer is configured for fitment on the nozzle base for spraying water into the wash container for facilitating washing of the utensils placed therewithin, wherein the sprayer is an elongated pipe having spray orifices configured thereon in a spaced apart configuration; and a lid configured for fitment for covering the operative top end of the cylindrical housing body;

wherein the cylindrical housing body has a compartmentalized configuration defined by a first wall and a second wall disposed in the cylindrical housing body, wherein the first wall and the second wall together define a wash container compartment, a wastewater tank compartment, and a clean water tank compartment within the cylindrical housing body;

wherein the lid includes openings for the wash container compartment, the clean water tank compartment, and the wastewater tank compartment that allow a cleaning basket to be freely removed by lifting the cleaning basket upwardly from the wash container compartment through a respective one of the openings along a first path free of obstruction, the clean water tank to be freely removed by lifting upwardly the clean water tank from the clean water tank compartment through a respective one of the openings along a second path free of obstruction, and the wastewater tank to be freely removed by lifting the wastewater tank upwardly from the wastewater tank compartment through a respective one of the openings along a third path free of obstruction.

2. The system according to claim 1, wherein the cleaning basket is configured to hold utensils therewithin to be washed.

3. The system according to claim 2, further comprising a first window configured on the cylindrical housing body for viewing a washing process within the cleaning basket.

4. The system according to claim 1, further comprising a second window configured on the cylindrical housing body for monitoring water level inside the clean water tank.

5. The system according to claim 1, further comprising a water heater tank comprising a heater coil disposed therein, the water heater tank disposed downstream from the first water pump.

6. The system according to claim 1, further comprising a trim for placement on an operative top end of the cylindrical housing body, the trim being configured to interface with a periphery of the cylindrical housing body, the first wall, and the second wall.

7. The system according to claim 6, wherein the lid is disposed on the trim.

* * * * *